US011287204B2

(12) United States Patent
Davidson

(10) Patent No.: US 11,287,204 B2
(45) Date of Patent: Mar. 29, 2022

(54) LAST ROUND BOLT HOLD-OPEN AND AUTOMATIC RELEASE MECHANISM

(71) Applicant: Michael J. Davidson, New Carlisle, OH (US)

(72) Inventor: Michael J. Davidson, New Carlisle, OH (US)

(73) Assignee: MD Arms, Ltd., New Carlisle, OH (US)

( * ) Notice: Subject to any disclaimer, the term of this patent is extended or adjusted under 35 U.S.C. 154(b) by 0 days.

(21) Appl. No.: 17/149,211

(22) Filed: Jan. 14, 2021

(65) Prior Publication Data

US 2021/0278156 A1 Sep. 9, 2021

Related U.S. Application Data

(60) Provisional application No. 62/960,730, filed on Jan. 14, 2020.

(51) Int. Cl.

| | |
|---|---|
| ***F41A 17/36*** | (2006.01) |
| ***F41A 9/70*** | (2006.01) |
| *F41A 15/12* | (2006.01) |
| *F41A 3/66* | (2006.01) |

(52) U.S. Cl.

CPC ..... *F41A 17/36* (2013.01); *F41A 9/70* (2013.01); *F41A 3/66* (2013.01); *F41A 15/12* (2013.01)

(58) Field of Classification Search

CPC ..... F41A 17/36; F41A 17/38; F41A 17/16; F41A 9/70; F41A 9/63; F41A 3/66; F41A 3/26; F41A 3/70; F41A 15/12; F41A 19/30

USPC ..... 89/137, 138, 128; 42/17, 75.03

See application file for complete search history.

(56) References Cited

U.S. PATENT DOCUMENTS

| | | | |
|---|---|---|---|
| 768,665 | A | 8/1904 | Johnson |
| 1,247,528 | A | 11/1917 | Hammond |
| 1,533,966 | A | 4/1925 | Browning |
| 4,057,003 | A | 11/1977 | Atchisson |
| 4,128,042 | A | 12/1978 | Atchisson |

(Continued)

OTHER PUBLICATIONS

Thomas F. Swearengen, The World's Fighting Shotguns, vol. IV, Ironside International Publishers, Alexandria, VA, 1978, pp. 338-353.

(Continued)

*Primary Examiner* — Michael D David

(74) *Attorney, Agent, or Firm* — Wood Herron & Evans LLP

(57) ABSTRACT

Provided is a last round bolt hold-open mechanism for a firearm with a removable ammunition magazine and a longitudinally reciprocating bolt that automatically releases the bolt when a loaded ammunition magazine is inserted. The mechanism includes a frame mountable to a firearm receiver and having a pair of mounting flanges. A catch member is pivotally mounted on a pivot axle oriented transverse to the longitudinal reciprocation of the bolt and carried by the mounting flanges. The catch member has a rearward portion that moves between bolt blocking and bolt release positions and is spring biased toward the bolt blocking position. A forwardly extending finger is configured to be lifted by the presence of at least one ammunition cartridge in the magazine and, when lifted, causes the catch member to pivot to the bolt release position.

13 Claims, 14 Drawing Sheets

(56) References Cited

U.S. PATENT DOCUMENTS

| | | | | |
|---|---|---|---|---|
| 6,510,778 | B1 | 1/2003 | Irwin | |
| 7,661,219 | B1 * | 2/2010 | Knight, Jr | F41A 35/06 42/70.02 |
| 10,228,201 | B2 | 3/2019 | Walther et al. | |
| 10,584,930 | B2 * | 3/2020 | Laney | F41A 9/74 |
| 2012/0066950 | A1 * | 3/2012 | Davidson | F41A 9/69 42/50 |
| 2015/0300761 | A1 * | 10/2015 | Delury | H04L 67/306 89/33.2 |
| 2015/0345886 | A1 * | 12/2015 | Lavalley | F41A 17/38 42/6 |
| 2019/0301822 | A1 * | 10/2019 | Laney | F41A 9/73 |

OTHER PUBLICATIONS

Brownells, Smith Tactics—AR-15 Lightning Bolt Release, https://www.brownells.com/rifle-parts/bolt-part, printed Dec. 18, 2019, 1 page.

* cited by examiner

LAST ROUND BOLT HOLD-OPEN AND AUTOMATIC RELEASE MECHANISM

CROSS REFERENCE TO RELATED APPLICATIONS

This Application is a Nonprovisional Application claiming priority to U.S. Provisional Patent Application 62/960,730, filed Jan. 14, 2020, the full disclosure of which is incorporated herein by reference.

TECHNICAL FIELD

This invention relates to a last round bolt hold-open mechanism for a firearms that locks the bolt in its reward position when the last round of ammunition in a magazine is fired. More specifically, the present invention teaches an improved last round bolt hold-open mechanism that automatically releases the bolt when a loaded magazine is inserted.

BACKGROUND

In the prior art, a last round bolt hold-open typically operates by engaging the bolt or bolt carrier group when an ammunition magazine becomes empty and the follower of the magazine lifts the bolt catch to block and hold the bolt. These also typically require a step to manually disengaged the catch after a loaded magazine in inserted in the weapon by either pressing a button or lever on the weapon or by pulling the weapon's charging handle rearward to release the catch. This method of operation requires another additional step for the operator to be ready to fire again after reloading because the step of disengaging the catch often causes a loss of aim and/or a break of cheek and or shoulder weld or a repositioning of the trigger finger or other digit to perform the release operation, after which the operator must reposition the hand or finger or digit used to perform the manual release. These additional steps required to return to firing can mean an operator is forced to delay fire and/or fire from a less supported and controlled weapon position and/or with an incomplete aim of the weapon.

A last round bolt hold-open is often biased by a spring to rest in a position that will not lock the bolt open if the follower is not tripping it. With this typical method, the follower being present in its upper most position in the magazine is all that ensures the bolt remains held open. Once the magazine is removed the bolt will typically remain locked open from the pressure exerted by the weapon's return spring by keeping the bolt carrier group pressed against the bolt catch and the force preventing the catch from dropping out of the bolt carrier group's path under the pressure of the bolt catch's spring. But, if the bolt is retracted when the magazine is removed, it will not remain open unless the bolt catch is manually manipulated at the same time. Because the typical bolt catch is biased to return to the unlocked position, it can be rather easy for a knock or jar of the weapon to cause the bolt carrier group to briefly bounce off the bolt catch and allow the bolt catch to be pivoted and pushed clear of the bolt carrier group after the magazine has been removed. When that happens, the bolt carrier group will close on an empty chamber and the operator must then pull the charging handle fully to its rearward position and release to recharge the weapon after a loaded magazine has been inserted.

SUMMARY OF THE INVENTION

The present invention provides a last round bolt hold open that either eliminates or greatly reduces the above-described shortcomings of typical prior art bolt catch devices. In an embodiment of this invention, the last round bolt hold-open is not activated by the follower being in its upper most position in the magazine after the last round is fired but depends on the presence or absence of the ammunition cartridge itself. The bolt catch is biased by a spring to either be in a position, or in a constant state of trying to return to a position, to catch the bolt carrier group. When an ammunition cartridge is present, it pivots the bolt catch out of the path of the bolt carrier group, and when no ammunition is present, the bolt catch will return to a position to catch the bolt carrier group.

A benefit to this method of operation is that when a magazine becomes empty and the bolt locks open, the operator only needs to replace it with a loaded magazine to return the weapon to a ready-to-fire state. As the loaded magazine is inserted, the top round of ammunition in the magazine presses against the round-sensing trip arm of the bolt catch, causing the bolt catch to pivot, and, in turn, releasing the bolt to automatically charge the weapon with a round of ammunition. An additional step of manually releasing the bolt is not required. Nor is the user required to reposition the bolt releasing hand, finger or digit to fire or better support the weapon for more accurate fire. In an intense moment where returning to fire as quickly as possible is imperative, the operator can leave the trigger finger in the ready position and the hand installing a magazine can remain on the magazine for an instant two-hand support of the weapon upon its lock and automatic charging. This time savings could mean the difference between life or death for the operator or others.

Another benefit of the present invention is that a knock or jar (impact) of the weapon while in the locked, open-bolt position causing a bolt carrier group bounce while the magazine is removed will not result in the bolt carrier group being released and closing on an empty chamber. Because the bolt catch is biased by its spring to remain in the bolt locking position, any bolt bounce will just find the bolt or bolt carrier group returning against the bolt catch after such a knock or jar.

Another advantage of the present invention is that the bolt catch can also serve as a secondary sear. In the event that a magazine becomes damaged or dirty enough to cause a delay in its speed of feeding a round to its upper most position in the magazine, the bolt catch will not have the round of ammunition present to prevent to bolt carrier group from locking. The bolt will lock open until the delayed feed trips the catch and automatically releases the bolt carrier group. This feature could be of great benefit in such a situation, while nothing in the typical prior art addresses this and would leave the operator with a failure to feed jam or a bolt carrier group closed on an empty chamber.

The present invention greatly expands the ability of the weapon to operate the bolt catch since it is dependent on the presence or absence of ammunition, instead of the follower. Many drum magazines that were not designed to operate the typical prior art bolt hold open will now allow the operation of the present invention and the vast majority of magazines will not require any modifications to do so. Those magazines that do require modification to operate in tandem with the present invention will likely only need very slight clearance made to them.

In an alternate embodiment, the follower may be modified so as to not trip the bolt release if an empty magazine is present.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
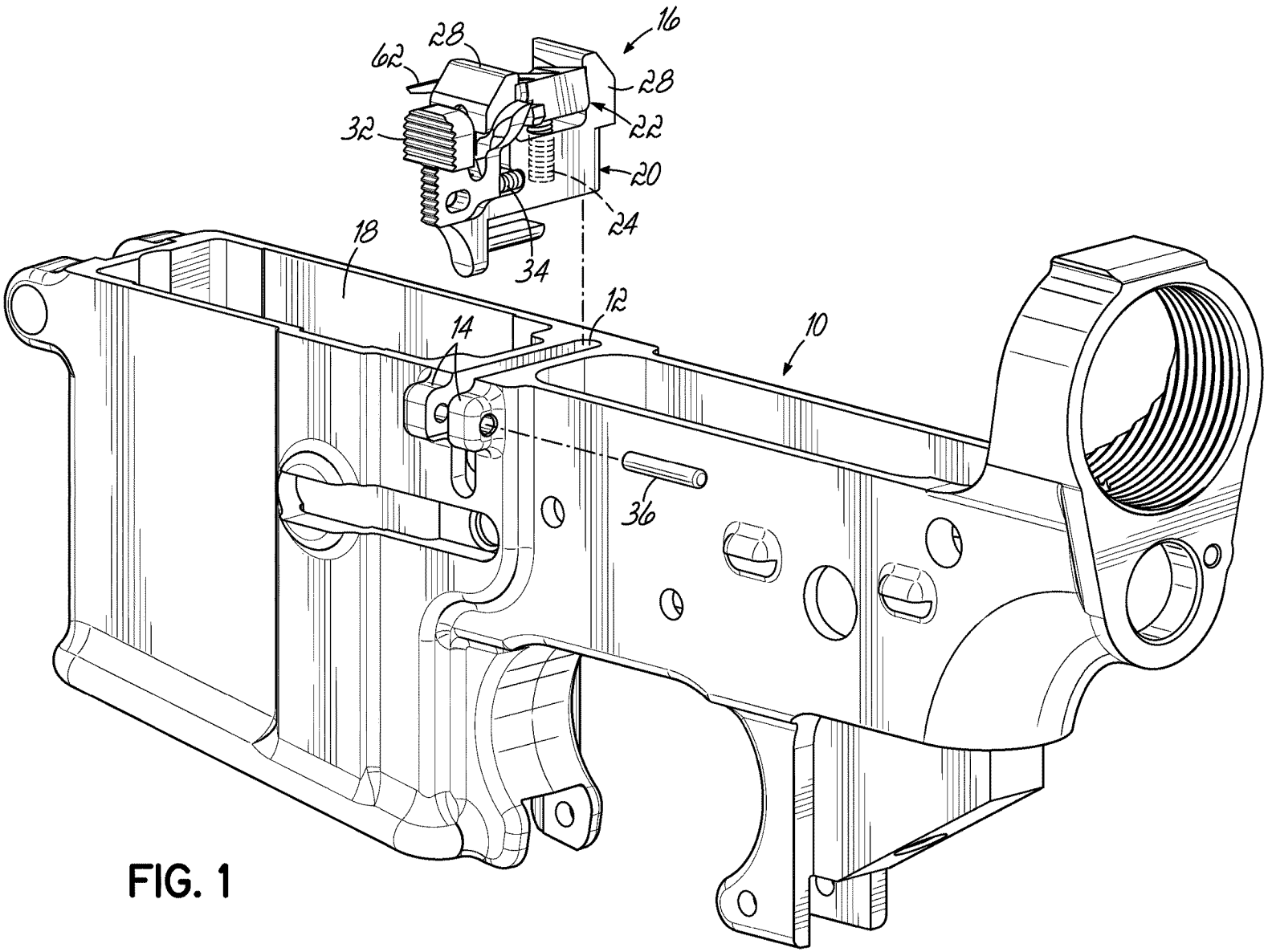
FIG. 1 is an isometric, partially exploded view of an automatically released last round bolt hold-open mechanism embodiment with an otherwise "stripped," standard (unmodified) AR-pattern lower receiver.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
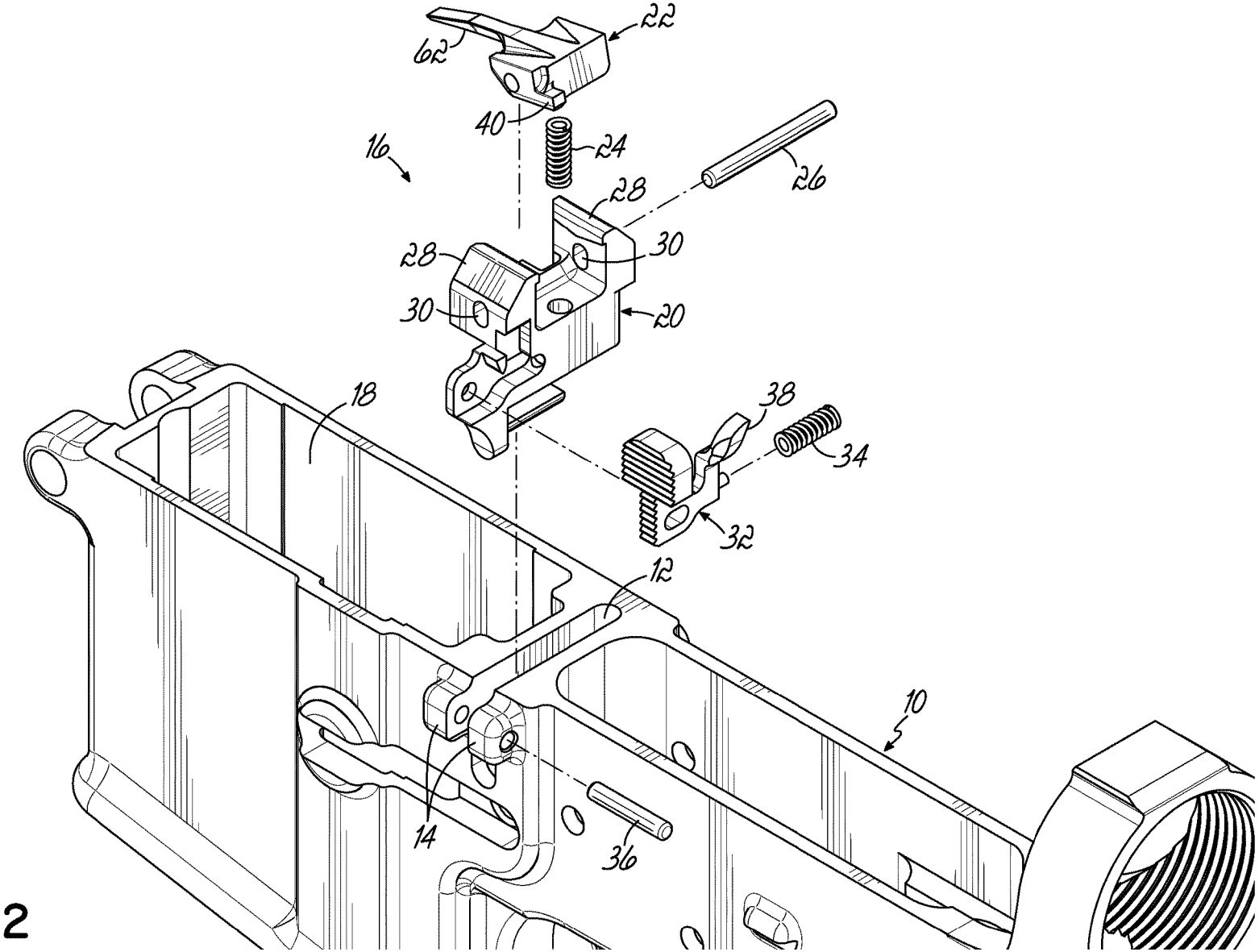
FIG. 2 is a similar view thereof fully exploded.
Figure 3:
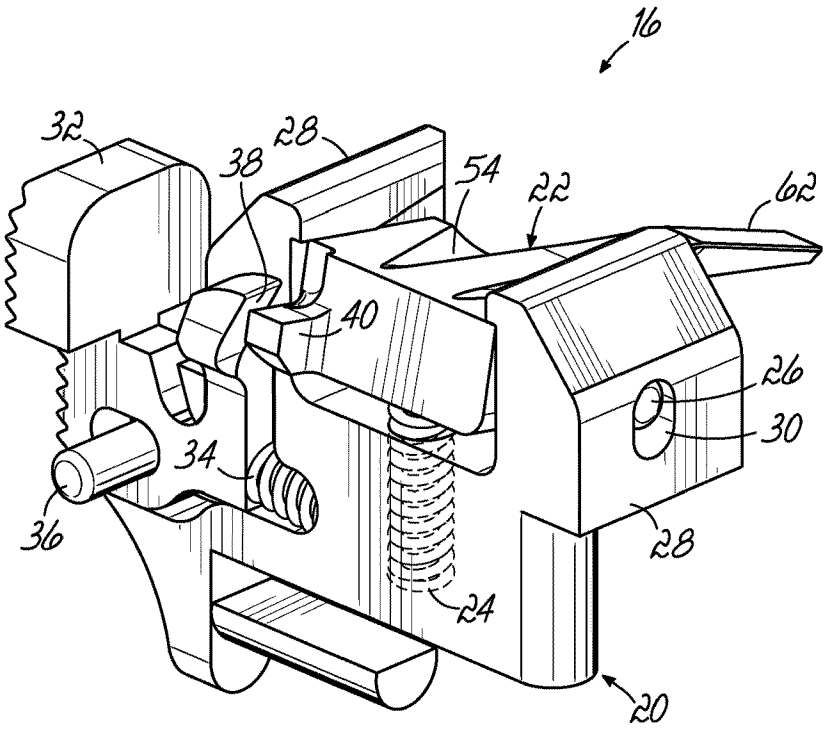
FIG. 3 is an isometric view of the mechanism with parts in their at-rest positions.

Referring first to FIGS. 1-3, therein is shown an AR-pattern lower receiver 10 of typical and ordinary design. "AR-pattern" includes the AR10, AR15, M16, M4, and other variants on the MIL-SPEC pattern. Other variations of a MIL-SPEC or non-MIL-SPEC lower receiver 10 may be used so long as the bolt catch pocket 12 and pivot flanges 14 are of standard dimensions, allowing it to receive the illustrated bolt catch and automatic release mechanism 16. Furthermore, while the illustrated embodiment of the mechanism 16 is retrofittable into a standard lower receiver 10, the invention could be integrated into a specialized lower receiver.

The bolt catch and auto release mechanism 16 of the present invention provides a device that will automatically lock the bolt (or bolt carrier group) in an open position when the last round has been fired and the magazine is empty, allow the bolt to be manually released, and automatically release the bolt when a magazine loaded with at least one ammunition cartridge is inserted into the magazine well 18.

In the illustrated embodiment, the mechanism 16 includes a frame 20 and a pivoting catch member 22. The catch member 22 is spring biased, such as by a coil spring 24, toward a blocking position, pivoting on a transverse pivot pin 26 that extends between upright support flanges 28. The pivot pin 26 may be carried in opposed openings 30 in the mounting flanges 28, which may be elongated in a vertical direction to allow vertical displacement of the axis of rotation (created by the pivot pin 26). The spring 24 keeps the pivoting catch member 22 biased toward the locking position, as well as biasing the pivot pin 26 toward an upward position in the elongated openings 30. In practice, the catch member could include multiple pivoting, linked parts, rather than the single part illustrated.

A manual release member 32, biased by another coil spring 34, may also be mounted on the frame 20. The assembled mechanism 16 is held into the bolt latch pocket 12 of the receiver 10, and the manual release member 32 slides (or pivots) on, an assembly pin 36 that extends through transversely aligned, opposed openings in the standard pivot flanges 14 of the lower receiver 10 and through an elongated opening in the manual release member 32. The assembly pin 36 may be a roll pin, as is commonly used for the pivot pin of a standard AR-pattern bolt catch/release device (not shown), or may be a threaded member, as is also well-known to be used for this part.

Figure 4:
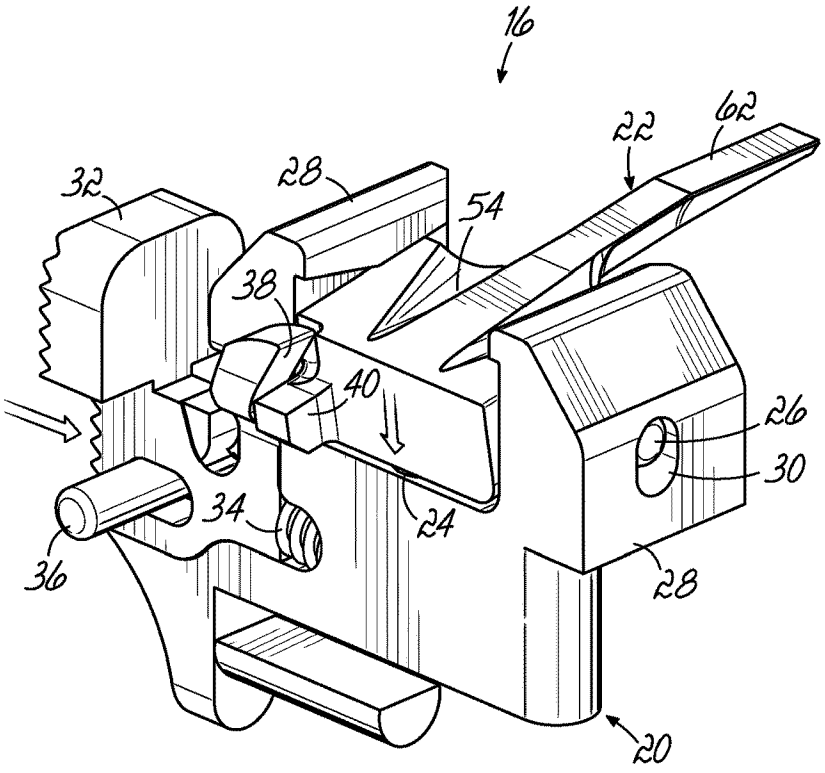
FIG. 4 is a similar view thereof in which the manual release button is pressed, causing rotation of the catch member to a release position.

As illustrated in FIG. 4, pressing on the manual release member 32 causes it to slide on the assembly pin 36 and compressing the coil spring 34. In the illustrated embodiment, the manual release member 32 is moved laterally in a medial direction from the left. However, an opposite side or ambidextrous actuator (not shown) could be implemented in the same way. As the manual release member 32 is moved, a cam surface 38 contacts a dog 40 on the catch member 22, causing the catch member 22 to pivot on the pivot pin 26 such that the rear end moves downwardly out of the locking position (locking position shown in FIG. 3).

Figure 5:
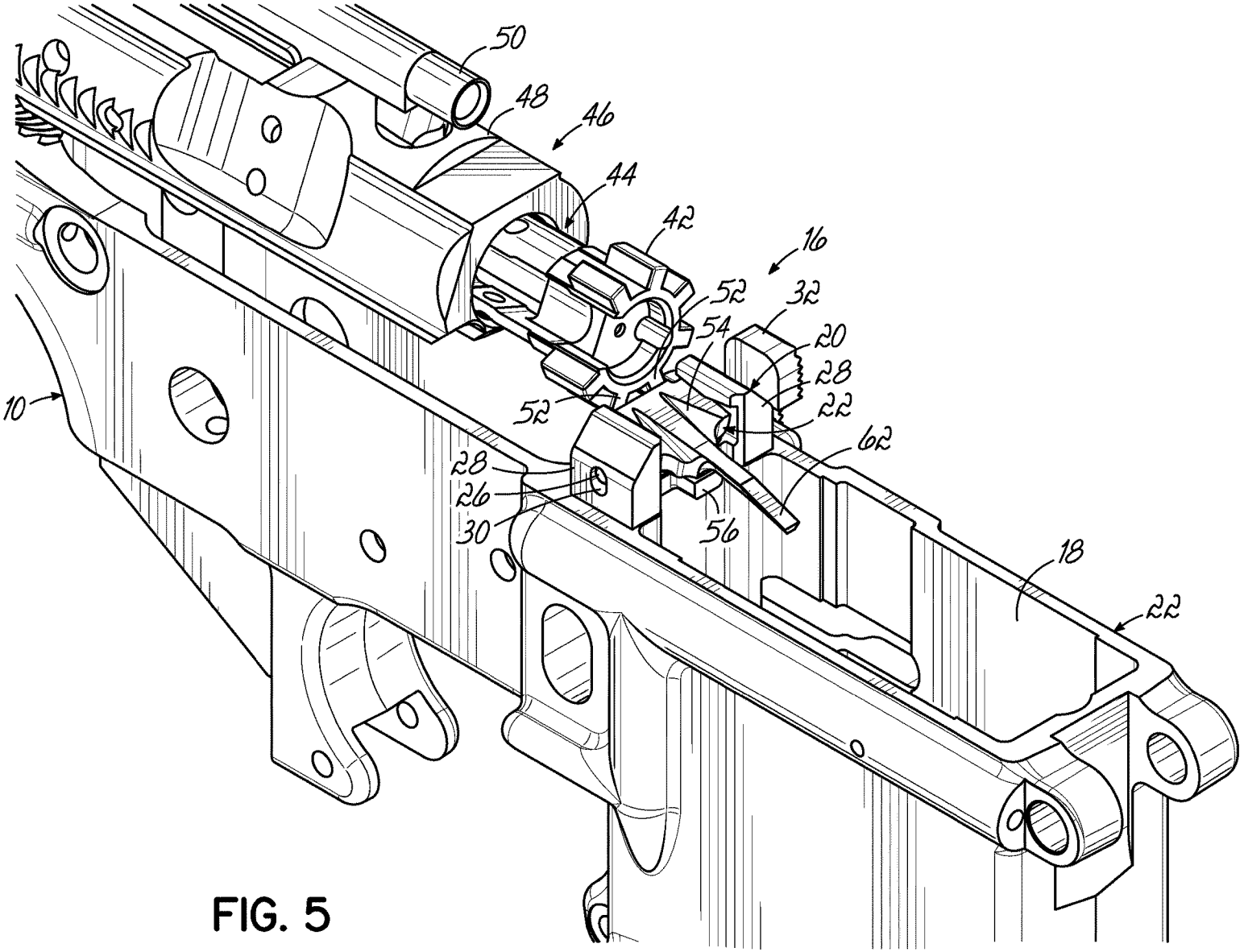
FIG. 5 is an enlarged, isometric view of the mechanism installed in an AR-pattern lower receiver without a magazine and with the bolt carrier retracted and held open (the upper receiver deleted for clarity)
Figure 6:
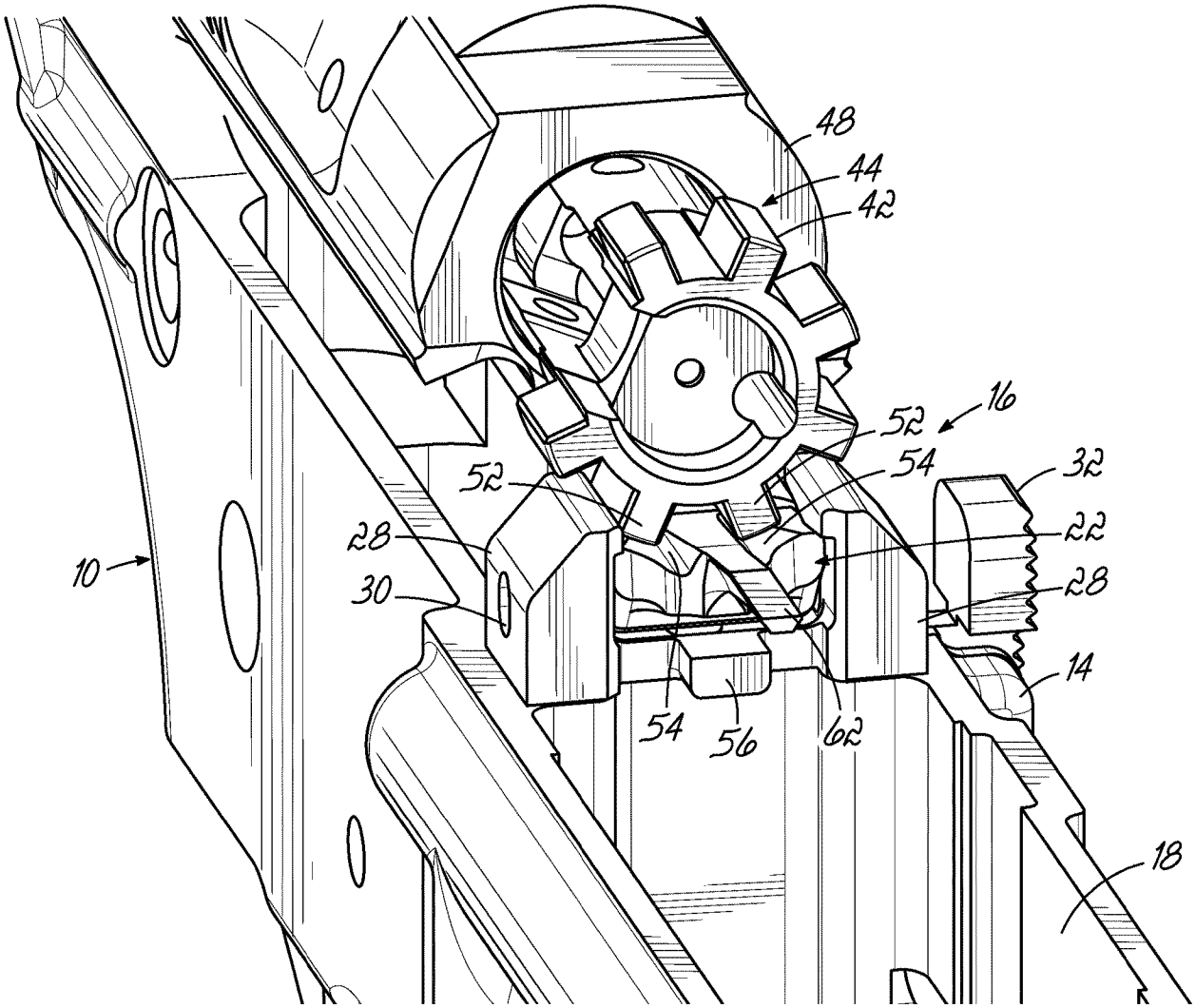
FIG. 6 is a further enlarged isometric view thereof with the bolt lugs shown passing across the catch member.
Figure 7:
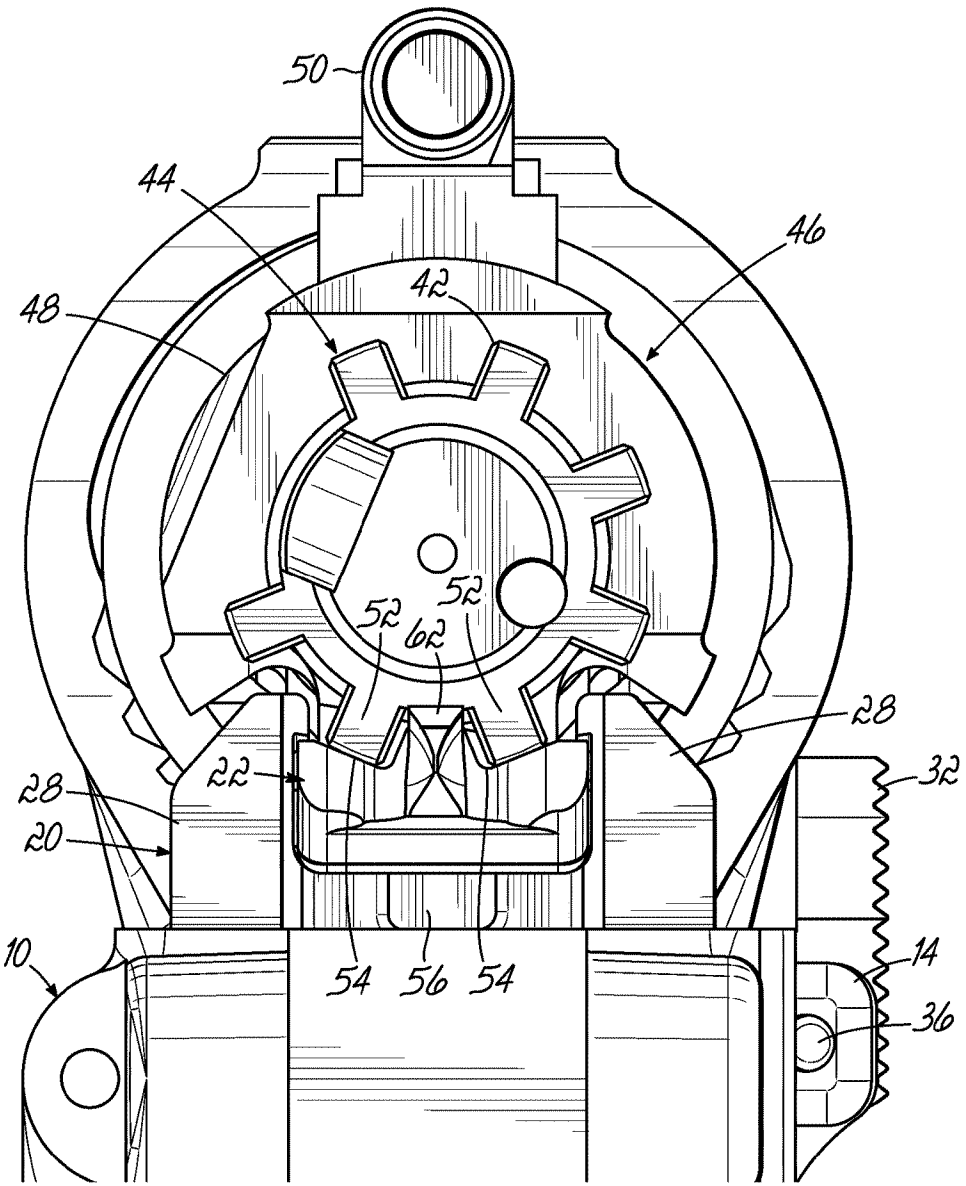
FIG. 7 is a partial front elevation view (looking to the rear) thereof.

Referring now to FIGS. 5-7, therein can be seen the spatial relationship between the mechanism 16 when installed in the lower receiver 10 and the head 42 of the bolt 44 when it is behind, forward of, or passing over the catch member 22. In these figures, the upper receiver has been completely removed for clarity of illustration. In use, the bolt carrier assembly 46, which includes at least the bolt 44, bolt carrier body 48, gas key 50, and other pertinent parts, reciprocates longitudinally in the upper receiver. Parts of the bolt carrier assembly 46 not relevant to explanation of the present invention (such as the extractor, ejector, and fire control group) have been omitted for simplicity in the illustrations.

In FIG. 5, we see the bolt carrier assembly 46 blocked in its fully retracted position by interference between the lugs 52 of the bolt head 42 with a rear edge of the catch member 22. In FIG. 6, we see the lugs 52 of the bolt head 42 passing across an upper surface of the catch member 22 as the bolt carrier assembly 46 reciprocates forwardly or to the rear. Channels 54 may be formed in the upper surface of the catch member 22 to allow smooth passage of the lugs 52 and reduce wear. Contact between the lugs 52 and the catch member 22 may deflect the catch member 22 downward against the coil spring 24 and lowering the axis of rotation defined by the pivot pin 26 within the vertically elongated openings 30 that allow for this deflection. As will be explained later, a bottom surface of the bolt carrier body 48 may also downwardly deflect the catch member 22 and pivot pin 26.

Figure 8:
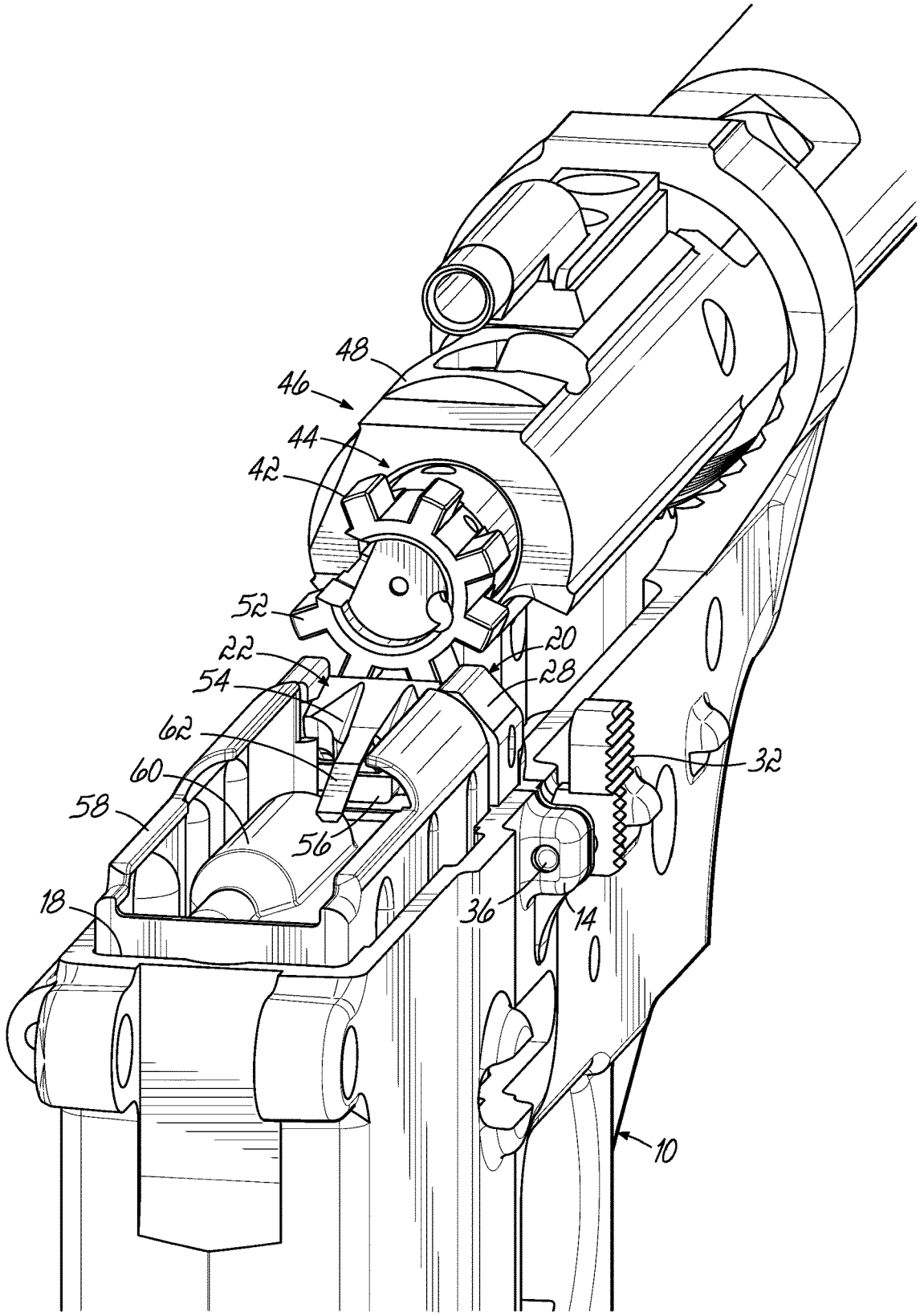
FIG. 8 is another isometric view showing the bolt carrier locked back by the catch and an empty magazine inserted in the lower receiver.

Referring now to FIG. 8, the frame 20 includes a forward protrusion 56 that projects into an ammunition magazine 58 seated in the magazine well 18 to limit upward movement of the follower 60. In this manner, the follower 60 is prevented from contacting (and actuating) the forwardly projecting finger 62 of the catch member 22. In a standard AR-patter firearm, the forward protrusion 56 may be received by a notch in the rear wall of the magazine 58 there for allowing the follower 60 to lift the standard bolt catch mechanism. Here, the magazine notch receives the forward protrusion 56 that holds the flower 60 down to prevent lifting the forwardly projecting finger 62.

Figure 9:
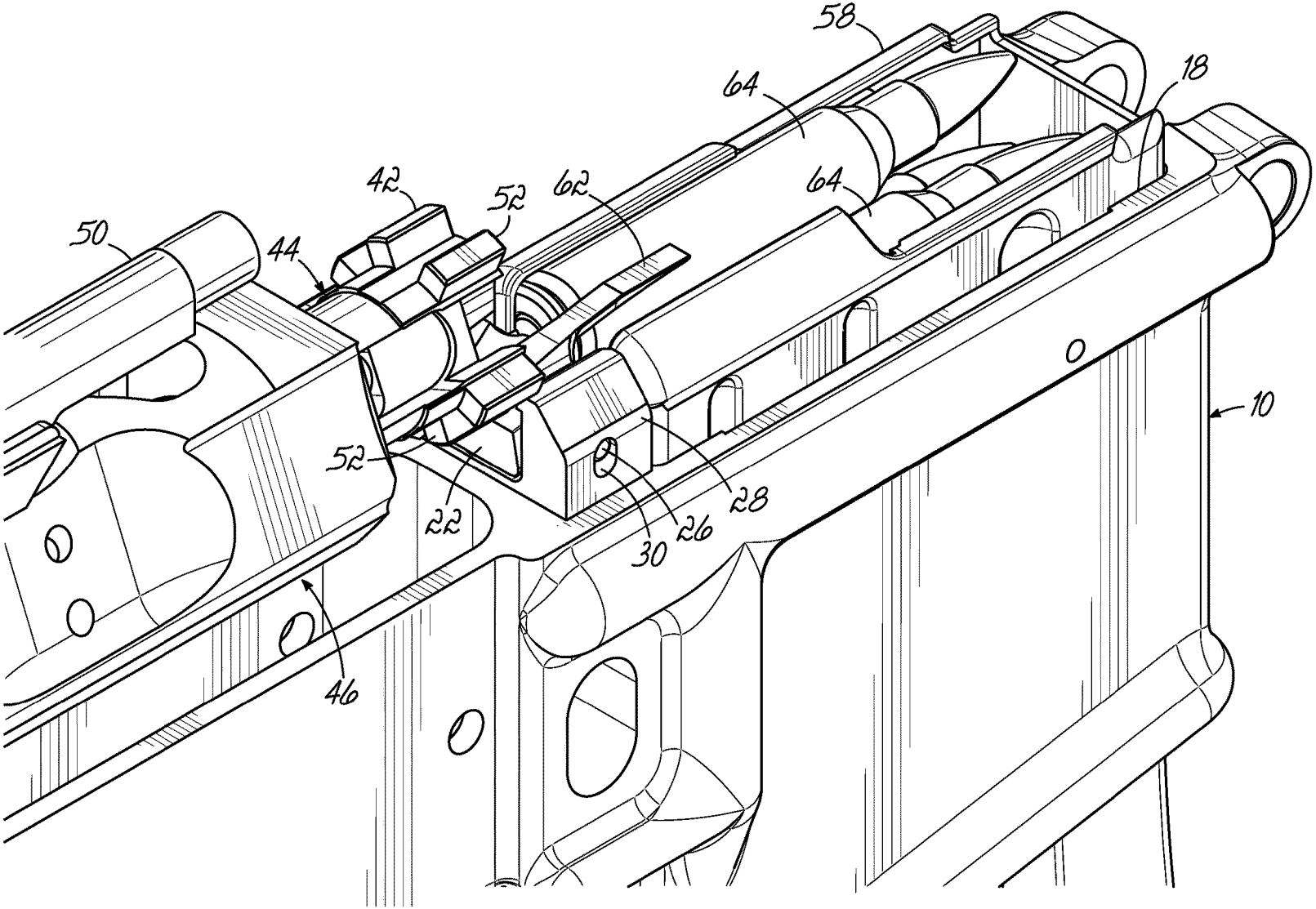
FIG. 9 is an alternate isometric view showing the bolt carrier retracted, but not locked back, with the bolt catch displaced by contact with an ammunition cartridge in the magazine.
Figure 10:
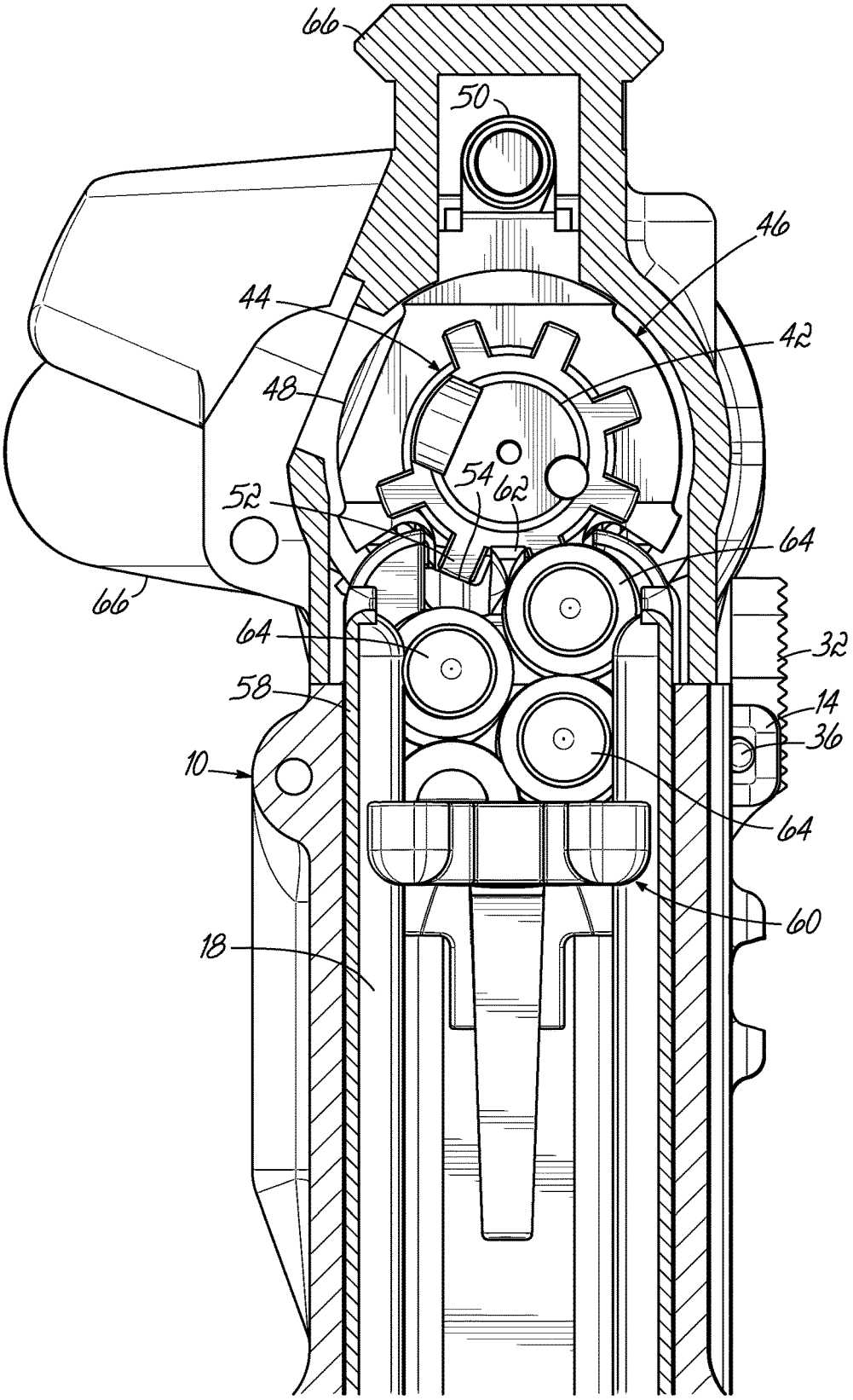
FIG. 10 is a partial cross-sectional front view showing the relative positions of the bolt face (retracted), bolt catch lever, magazine, and follower with three cartridges.

Referring now to FIGS. 9 and 10, therein is illustrated the manner in which the forwardly projecting finger 62 is contacted by an ammunition cartridge 64 in the magazine 58, causing the catch member 22 to rotate toward its release position in which the rear edge has pivoted downward out of interference engagement with the lugs 52 of the bolt head 42. As illustrated in FIG. 9, the bolt carrier assembly 46, when released by the catch member 22, would be driven forward by a recoil spring (not shown), over the catch member 22 and stripping the top cartridge 64 from the magazine 58 to chamber it in the barrel (not shown). As shown in FIGS. 9 and 10, the finger 62 is situated at or near the lateral centerline so as to be actuated by the presence of a cartridge 64 on either side of the multi-column stack, while also avoiding interference contact with longitudinal movement of the bolt lugs 52.

Figure 11:
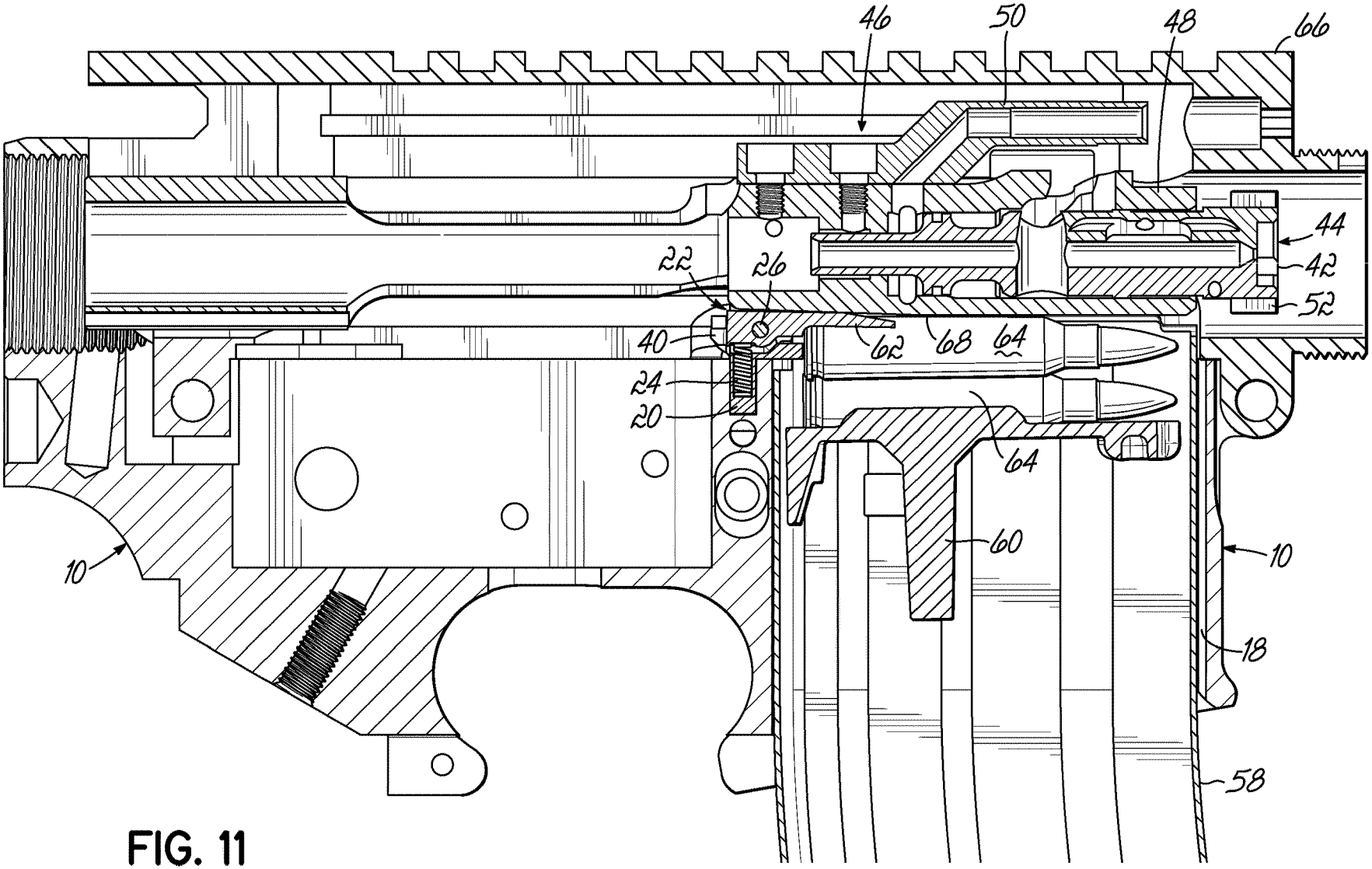
FIG. 11 is a fragmentary side sectional view showing the bolt carrier in a closed (in-battery) position.

FIGS. 11-14 show enlarged longitudinal section views with the bolt carrier assembly 46 at different longitudinal positions and with ammunition cartridges 64 either present or absent from the magazine 58. An upper receiver 66 is partially shown in these views, though all barrel structures have been omitted for clarity. In FIG. 11, the bolt carrier assembly 46 is in the fully forward, in-battery position. In this position, a bottom surface 68 of the bolt carrier body 48 is situated directly above ammunition cartridges 64 in the magazine 58 and the catch member 22 of the bolt catch and auto-release mechanism 16. As is typical in a standard AR-pattern configuration, when the bolt carrier assembly 46 is in the in-battery position, its bottom surface may contact and slightly depress any ammunition cartridge 64 against the spring-biased follower 60. Likewise, the bottom surface 68 may bear against the catch member 22 of the present invention, causing downward deflection of it and the pivot pin 26 in the vertically elongated openings 30 of the support flanges 28 against the spring 24.

Figure 12:
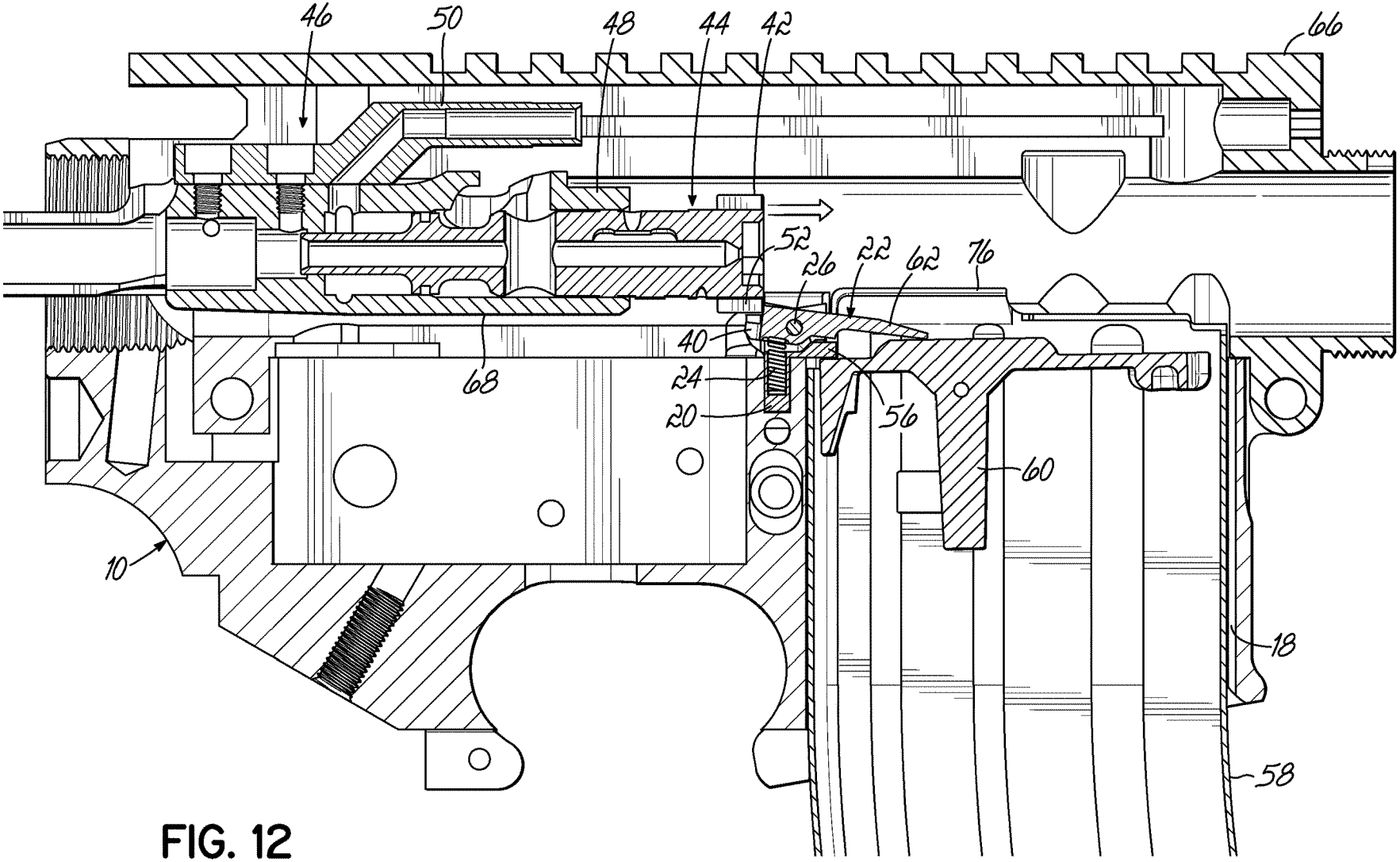
FIG. 12 is a similar view showing the bolt carrier in a retracted and locked back position with an empty magazine.

FIG. 12 shows a similar view in which the bolt carrier assembly 46 is fully retracted and the face of the bolt head 42 is engaged with and blocked by a rear edge of the catch member 22 that has been pivoted to the blocking position by the coil spring 24. Because the magazine 58 is empty of ammunition cartridges 64 and the upward position of the follower 60 is limited by the forward protrusion 56, there is nothing contacting the forwardly projecting fingers 62.

Figure 13:
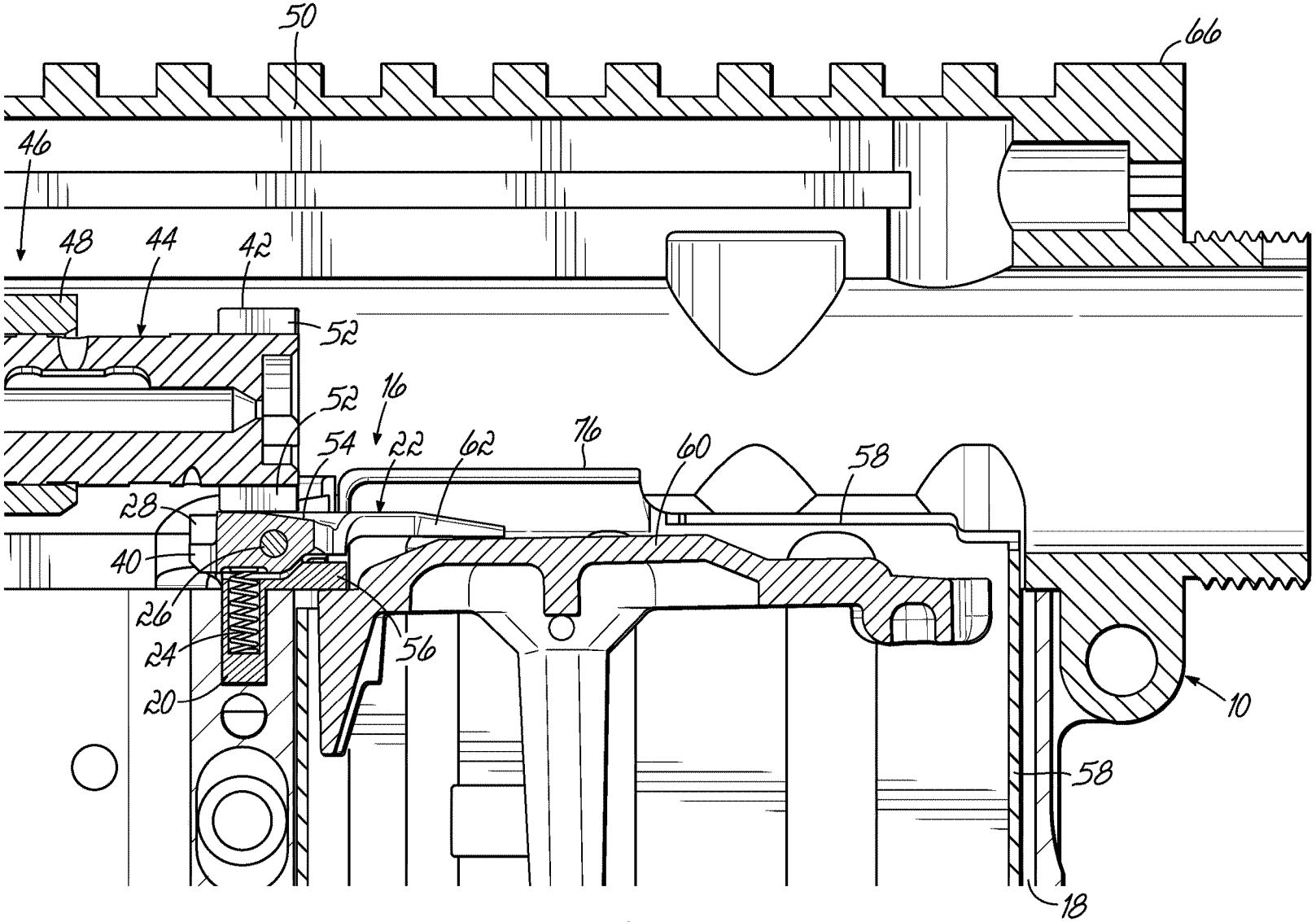
FIG. 13 is a similar view showing the bolt carrier in an intermediate position where the bolt lugs are passing across the bolt catch member with an empty magazine.

FIG. 13 shows a similar view with an empty magazine 58 in which the lugs 52 of the bolt head 42 are passing rearwardly over the catch member 22. Because the magazine is empty, as soon as the bolt head 42 has retracted to the rear of the catch member 22, the catch member 22 will be biased by the spring 24 into the blocking position to lock the bolt carrier assembly 46 in the open position.

Figure 14:
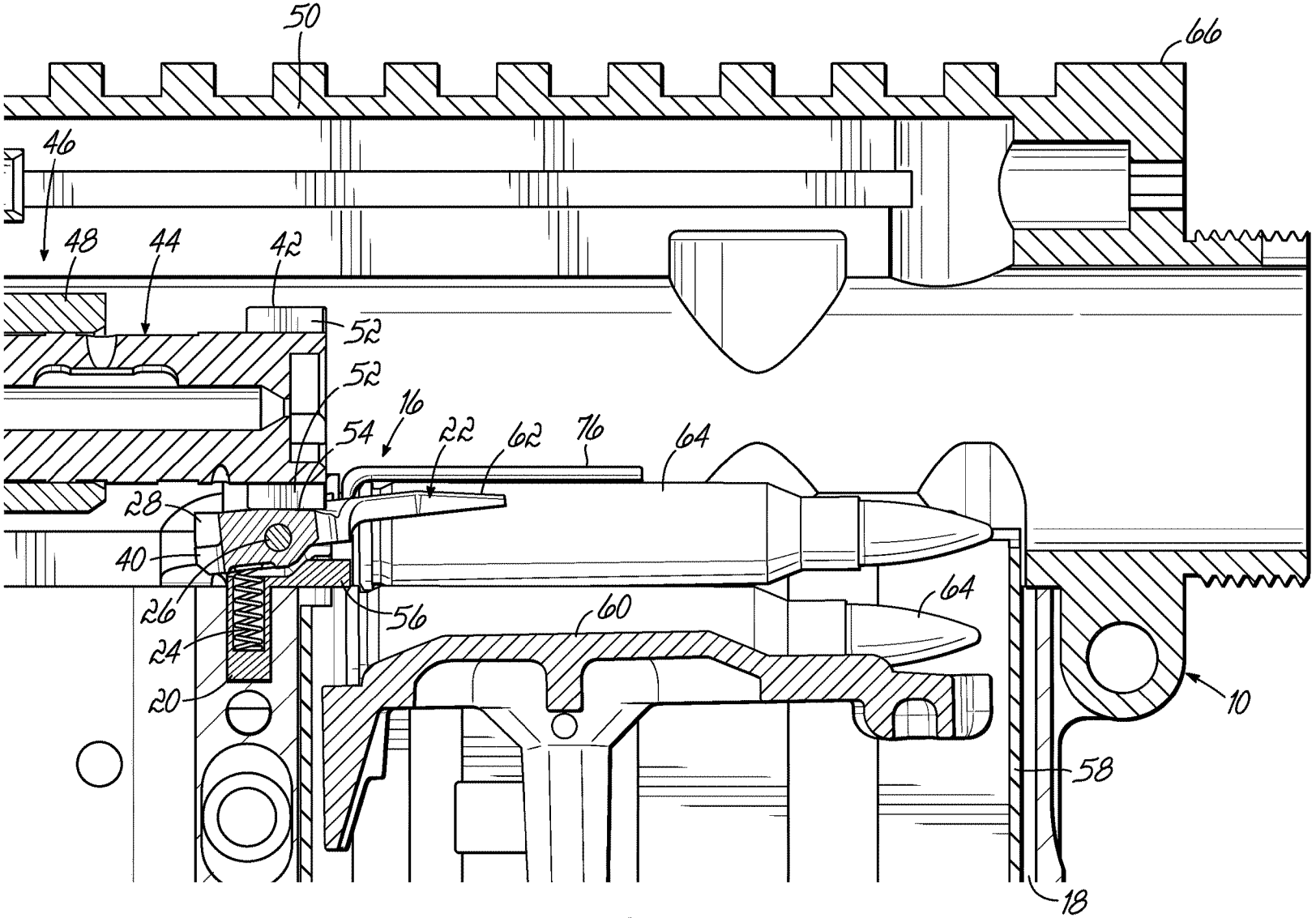
FIG. 14 is a similar view showing the bolt carrier in an intermediate position where the bolt lugs are passing across the bolt catch member with a loaded magazine.

FIG. 14 shows a similar view and position of the bolt head 42, except that because ammunition cartridges 64 are present in the magazine 58 and the forwardly projecting fingers 62 of the catch member 22 are lifted, pivoting the catch member 22 against the force of the spring 24 into a non-blocking position. As soon as the bolt carrier assembly 46 reaches its rearward end of travel, the recoil spring will drive it forward (illustrated by an arrow). Because the catch member is in the release position, the lugs 52 of the bolt head 42 will strip an ammunition cartridge 64 from the magazine 58 as it moves forward to chamber the round.

FIG. 14 illustrates two conditions. One is where the bolt carrier assembly 46 is cycling automatically and the magazine 58 is not yet empty. The other is where a loaded magazine 58 has just been seated in the magazine well 18 and the top cartridge 64 has displaced the forwardly extending finger 62 of the catch member 22, causing the catch member 22 to pivot to the release position and release the bolt carrier assembly 46 to travel forward.

Figure 15:
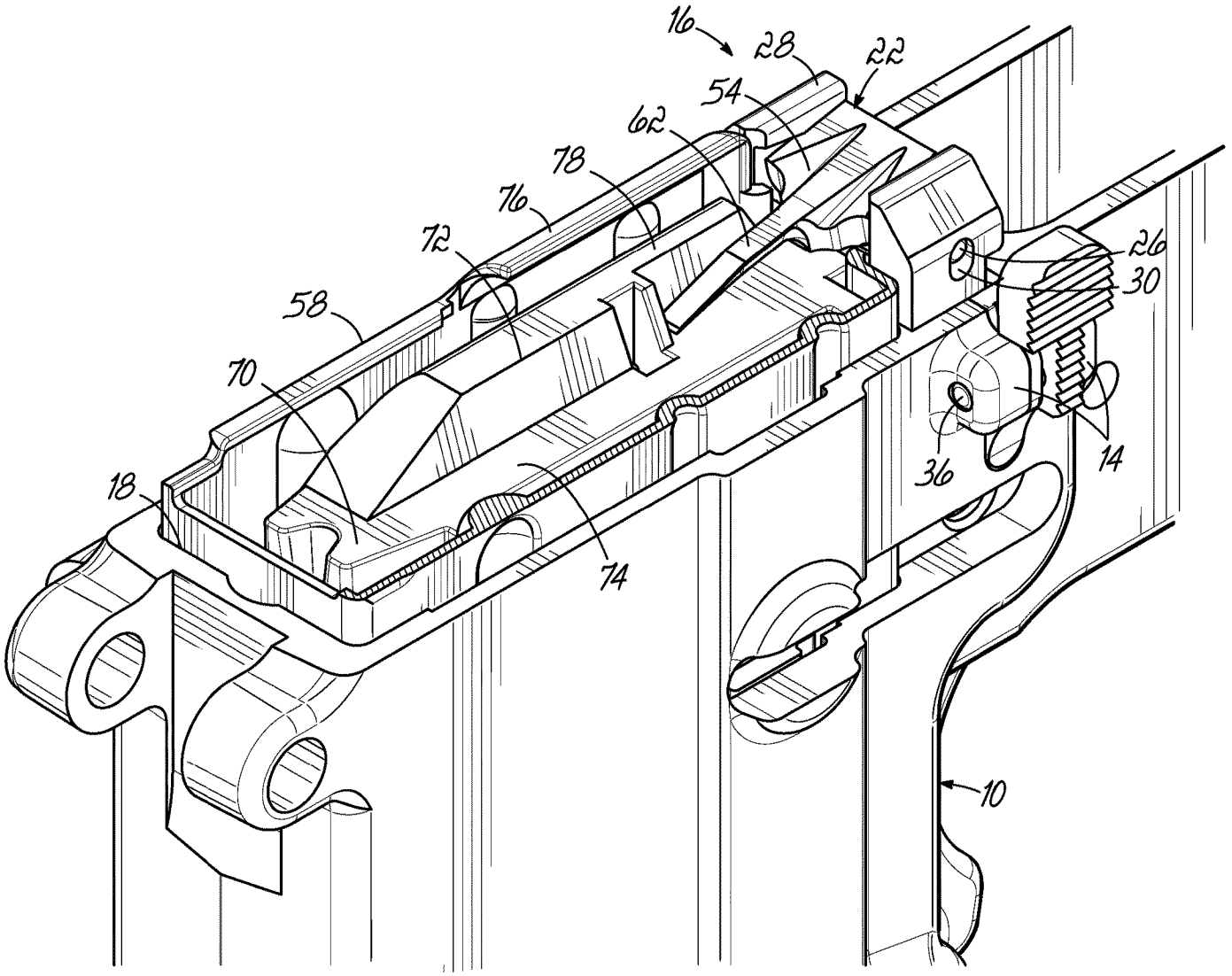
FIG. 15 is a partially cut away isometric view showing a modified follower that does not trip the bolt release when no ammunition is present, even when at its highest position in the magazine.

FIG. 15 shows an alternate embodiment implementing a modified follower 70. Like other followers, the modified follower 70 includes a raised portion 72 extending forward-to-rear along one side and a lower surface portion 74 extending forward-to-rear along the other lateral side. The raised portion 72 causes or facilitates feeding cartridges 64 in an alternating, staggered stack and advances the final cartridge to a ready-to-be-fed position between the magazine's feed lips 76. In essence, the raised portion 72 mimics a portion of the position of another, staggered ammunition cartridge.

In an ordinary follower 60, this raised portion 72 would or could contact and lift the forwardly projecting finger 62, as explained above, when it reached the topmost position of travel in a seated magazine 58. In this embodiment, rather than a forward protrusion 56 holding the follower down, the modified follower 70 includes a recess 78 in some or all of the rear part of the raised portion 72 that receives and avoids displacing contact with the forwardly projecting finger 62. For contrast, compare FIG. 8 to FIG. 15. This recess 78 does not otherwise affect the feeding function of the follower 70, as there remains sufficient raised surface area to position the cartridge(s) 64.

While one or more embodiments of the present invention have been described in detail for both mil-spec and non-mil-spec variations of an AR15 in 5.56 mm/.223 caliber, it should be apparent that modifications and variations thereto are possible including but not limited to any caliber and or type of rifle, pistol, and shotgun ammunitions and across a wide range of weapon platforms and types including pistols, carbines and long guns but not limited to, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction, components, and operation shown and described. Accordingly, all suitable modifications and equivalents may be included and considered to fall within the scope of the invention, defined by the following claim or claims.

What is claimed is:

1. A last round bolt hold-open mechanism configured for a firearm with a removable ammunition magazine and a longitudinally reciprocating bolt that automatically releases the bolt when a loaded ammunition magazine is inserted, the mechanism comprising:

a frame on a firearm receiver and having at least one mounting flange; and a catch member pivotally mounted on a pivot axle oriented transverse to the longitudinal reciprocation of the bolt and carried by the mounting flange, the catch member having a rearward portion that moves between bolt blocking and bolt release positions, spring biased toward the bolt blocking position, and a forwardly extending finger configured to be lifted by the presence of at least one ammunition cartridge in the magazine and, when lifted, causing the catch member to pivot to the bolt release position.

2. The mechanism of claim 1, wherein the forwardly extending finger is situated forward of the pivot axle and the rearward portion is situated rearward of the pivot axle.

3. The mechanism of claim 1, wherein the pivot axle has an axis of rotation that is vertically displaceable.

4. The mechanism of claim 3, wherein the pivot axle is upwardly spring biased.

5. The mechanism of claim 1, further including a forward protrusion situated to limit upward travel of an ammunition magazine follower.

6. The mechanism of claim 1, further comprising an ammunition magazine with a follower, the follower having a raised portion with a recess portion configured to receive the forwardly extending finger when the magazine is inserted in the receiver and contains no ammunition cartridge.

7. The mechanism of claim 1, further comprising a manual actuation lever to engage the catch member and manually move the catch member to the bolt release position.

8. A last round bolt hold-open mechanism configured for an AR-pattern firearm lower receiver with a longitudinally reciprocating bolt that automatically releases the bolt when a loaded ammunition magazine is inserted, the mechanism comprising:

a frame mountable in a bolt catch pocket of the lower receiver and having at least one extending mounting flange; and a catch member pivotally mounted on a pivot axle oriented transverse to the longitudinal reciprocation of the bolt and carried by the mounting flange, the catch member having a rearward portion that moves between bolt blocking and bolt release positions, spring biased toward the bolt blocking position, and a forwardly extending finger configured to be lifted by the presence of at least one ammunition cartridge in the magazine and, when lifted, causing the catch member to pivot to the bolt release position.

9. The mechanism of claim 8, wherein the frame is secured to the receiver by a pin supported by flanges laterally protruding from the receiver.

10. The mechanism of claim 8, further comprising a manual actuation lever to engage the catch member and manually move the catch member to the bolt release position.

11. The mechanism of claim 9, wherein the frame secured to the receiver by a pin supported by flanges laterally protruding from the receiver and the pin provides a pivot axle for the actuation lever.

12. The mechanism of claim 8, wherein the frame includes a forward protrusion situated to limit upward travel of an ammunition magazine follower.

13. The mechanism of claim 8, further comprising an ammunition magazine with a follower, the follower having a raised portion with a recess portion configured to receive the forwardly extending finger when the magazine is inserted in the receiver and contains no ammunition cartridge.

* * * * *